US010223884B2

(12) United States Patent
Bisesti et al.

(10) Patent No.: US 10,223,884 B2
(45) Date of Patent: Mar. 5, 2019

(54) RECOILER SENSOR

(71) Applicant: InVue Security Products Inc., Charlotte, NC (US)

(72) Inventors: Robert Bisesti, Charlotte, NC (US); William B. Howell, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

(21) Appl. No.: 15/310,493

(22) PCT Filed: May 19, 2015

(86) PCT No.: PCT/US2015/031508

§ 371 (c)(1),
(2) Date: Nov. 11, 2016

(87) PCT Pub. No.: WO2015/179357

PCT Pub. Date: Nov. 26, 2015

(65) Prior Publication Data

US 2017/0076569 A1 Mar. 16, 2017

Related U.S. Application Data

(60) Provisional application No. 62/000,674, filed on May 20, 2014.

(51) Int. Cl.
*G08B 13/14* (2006.01)

(52) U.S. Cl.
CPC ..... *G08B 13/1463* (2013.01); *G08B 13/149* (2013.01)

(58) Field of Classification Search
CPC ..... G08B 13/1463; G08B 13/149
See application file for complete search history.

(56) References Cited

U.S. PATENT DOCUMENTS 3,812,307 A 5/1974 Wagner et al.
5,570,080 A 10/1996 Inoue et al.
(Continued)

FOREIGN PATENT DOCUMENTS

CN 101283383 A 10/2008
CN 203480670 U 3/2014
WO 2011116044 A2 9/2011

OTHER PUBLICATIONS

International Search Report and Written Opinion for corresponding International Patent Application No. PCT/US2015/031508 filed May 19, 2015; date of completion of the search Jul. 22, 2015; 8 pages.

(Continued)

*Primary Examiner* — Sisay Yacob
(74) *Attorney, Agent, or Firm* — InVue Security Products Inc.

(57) ABSTRACT

A merchandise security device for securing items of merchandise from theft is provided. The merchandise security device may include a printed circuit board and a base containing the printed circuit board. The security device may include a sensor electrically connected to the printed circuit board and configured to engage a support surface for detecting unauthorized removal of the base from the support surface. The security device may also include a tether configured to be coupled to one or more items of merchandise, and a spool rotatably disposed within the base for winding and unwinding the tether, wherein the tether is configured to be extended and retracted relative to the base. The printed circuit board is coupled to the spool such that the printed circuit board is configured to rotate relative to the base when the tether is extended and retracted, and the sensor is configured to remain stationary when the tether is extended and retracted.

20 Claims, 5 Drawing Sheets

(56) References Cited

U.S. PATENT DOCUMENTS

| | | | | |
|---|---|---|---|---|
| 6,925,967 | B1 * | 8/2005 | Woodruff | A01K 27/004 119/712 |
| 7,053,774 | B2 * | 5/2006 | Sedon | A47F 7/024 206/807 |
| 7,385,522 | B2 | 6/2008 | Belden, Jr. et al. | |
| 8,368,536 | B2 * | 2/2013 | Fawcett | G08B 13/1463 340/568.1 |
| 8,405,507 | B2 | 3/2013 | Belden, Jr. et al. | |
| 8,596,595 | B2 | 12/2013 | Devito | |
| 8,604,927 | B2 | 12/2013 | Sisney | |
| 2005/0160864 | A1 * | 7/2005 | Glasson | F15B 15/283 74/500.5 |
| 2008/0035778 | A1 | 2/2008 | Belden et al. | |
| 2009/0058643 | A1 | 3/2009 | Groth | |
| 2014/0015674 | A1 * | 1/2014 | Fawcett | G08B 13/149 340/568.8 |
| 2014/0027390 | A1 | 1/2014 | Reynolds et al. | |

OTHER PUBLICATIONS

First Office Action from corresponding Chinese patent application No. 201580025383.0, dated Mar. 27, 2018 (14 pages).

* cited by examiner

RECOILER SENSOR

CROSS REFERENCE TO RELATED APPLICATIONS

This application claims the benefit to priority of U.S. Provisional Patent Application No. 62/000,674 filed on May 20, 2014, the entire disclosure of which is incorporated herein by reference.

FIELD OF THE INVENTION

Embodiments of the present invention relate generally to merchandise display security devices, systems, and methods for protecting an item of merchandise from theft.

BACKGROUND OF THE INVENTION

It is common practice for retailers to store and/or display relatively expensive items of merchandise on or within a merchandise security device, such as a security display (e.g. alarming stand), security fixture (e.g. locking hook, shelf, cabinet, etc.) or security packaging (e.g. merchandise keeper). Regardless, the security device stores and/or displays an item of merchandise so that a potential purchaser may view, and in some instances, interact with the item before making a decision whether to purchase the item. At the same time, the item is secured on or within the merchandise security device so as to prevent, or at least deter, theft of the item. The value of the item, however, may make it an attractive target for a shoplifter despite the presence of a merchandise security device. A determined shoplifter may attempt to detach the item from the security display or to remove the item from the security fixture or from within the security packaging. Alternatively, the shoplifter may attempt to remove the all or a portion of the security device from the display area along with the item.

In the case of a secure display or fixture, the security device is oftentimes firmly attached to a support, such as a pegboard, wire grid, horizontal bar rack, slatwall (also known as slatboard), wall, table, desk, countertop or like structure. In some instances, the security device is secured to the support using a mechanical lock mechanism.

BRIEF SUMMARY

Embodiments of the present invention are directed to merchandise security devices and method for securing items of merchandise from theft. In one embodiment, a merchandise security device includes a printed circuit board and a base containing the printed circuit board. The security device also includes a sensor electrically connected to the printed circuit board and configured to engage a support surface for detecting unauthorized removal of the base from the support surface. In addition, the security device includes a tether configured to be coupled to one or more items of merchandise and a spool rotatably disposed within the base for winding and unwinding the tether, wherein the tether is configured to be extended and retracted relative to the base. The printed circuit board is coupled to the spool such that the printed circuit board is configured to rotate relative to the base when the tether is extended and retracted, and the sensor is configured to remain stationary when the tether is extended and retracted.

According to another embodiment, a merchandise security device includes a printed circuit board and a base containing the printed circuit board. The security device further includes a sensor electrically connected to the printed circuit board and configured to engage a support surface for detecting unauthorized removal of the base from the support surface, and the printed circuit board is configured to rotate relative to the base while the sensor remains stationary.

With respect to another embodiment, a method is provided and includes securing a security device to a support surface such that a sensor engages the support surface, wherein the sensor is electrically connected to a printed circuit board and configured to detect unauthorized removal of the security device from the support surface. The method also includes coupling a tether to at least one item of merchandise, the wherein the tether is secured to the security device and configured to be wound onto and unwound from a rotatable spool. Moreover, the method includes extending or retracting the tether such that the printed circuit board rotates relative to the base and the sensor remains stationary.

DETAILED DESCRIPTION OF EMBODIMENTS OF THE INVENTION

Figure 1:
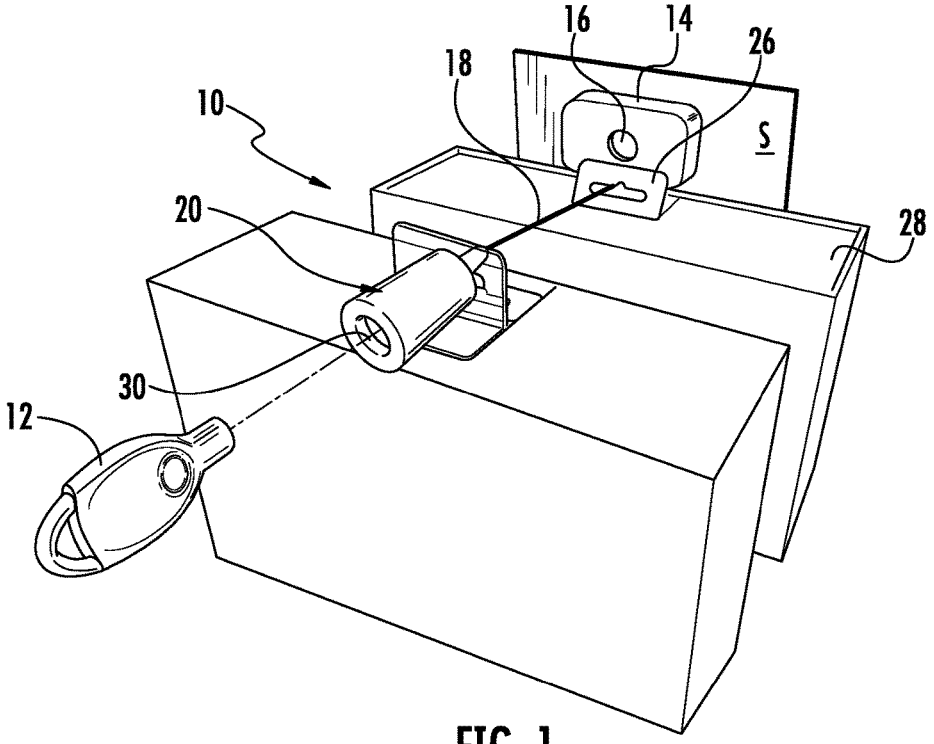
FIG. 1 is a perspective view of a merchandise display security system according to one embodiment of the present invention.

Referring now to the accompanying drawing figures wherein like reference numerals denote like elements throughout the various views, one or more embodiments of a merchandise security device are shown. In some embodiments shown and described herein, the merchandise security device is employed for shelf security whereby items of merchandise displayed on a shelf or other support surface "S" are secured. For example, the merchandise security device may be suitable for use with a variety of display surfaces, such as pegboard, slat board, slat wall, and the like. It is understood that the merchandise security device may be suitable for protecting any desired item of merchandise.

Figure 2:
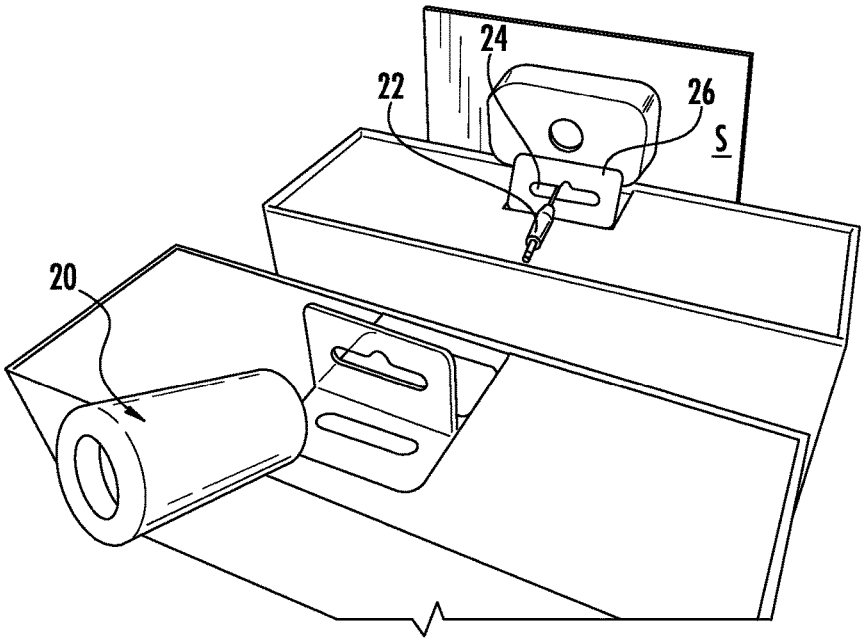
FIG. 2 is a partially disassembled view of the merchandise display security system shown in FIG. 1.
Figure 3:
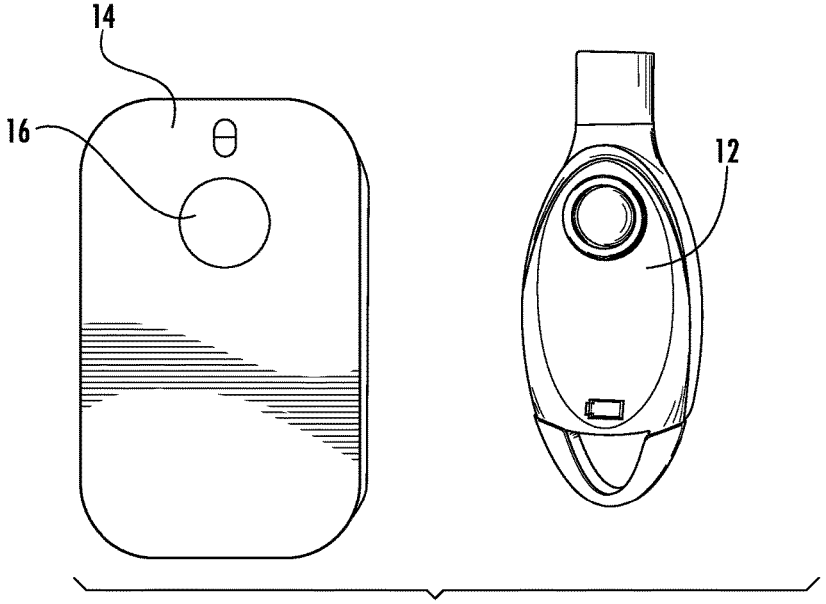
FIG. 3 is a plan view of a base and a key according to one embodiment of the present invention.

FIGS. 1-3 illustrate an embodiment of a security device 10 configured to cooperate with an electronic key 12 for locking and/or unlocking a lock mechanism. In some embodiments, the electronic key 12 is also configured to arm and disarm an alarm circuit. FIG. 1 shows that the security device 10 generally includes a base 14 configured to be secured to a support surface "S", such as, for example, pegboard, slat wall, slat board, and the like. In some cases, the base 14 may be secured to any surface with an adhesive and/or fasteners. The base 14 may include a transfer port 16 for communicating with an electronic key 12. Thus, in some cases, the base 14 may include an alarm circuit that is configured to be armed and/or disarmed with an electronic key 12. However, in other embodiments, the base 14 may simply provide mechanical security for securing the base to a support surface S. The security device 10 further includes a tether 18 that is configured to extend and retract relative to the base 14. The tether 18 may be coupled to one or more items of merchandise 28 such that each item of merchandise is able to slide along the tether 18.

FIGS. 4-10 illustrate another embodiment of a security device 50. The security device 50 may be configured to secure one or more items of merchandise 28 from theft. In one embodiment, a recoiler 54 is provided that includes or is otherwise coupled to a tether 52. The recoiler 54 may include a spool 56, and the tether 52 may be configured to be wound on the spool and to unwind as tension is applied to the end of the tether. The recoiler 54 may be biased to retract the tether 52 within the base 58 and onto the spool 56, such as with a suitable spring. The tether 52 may be configured to be coupled to one or more items of merchandise 28. In some embodiments, the tether 52 provides mechanical security only, while in other embodiments, the tether may include one or more conductors 55 electrically connected to an alarm circuit 57 (see, e.g., FIG. 9). Thus, the alarm circuit 57 may be configured to detect when the tether 52 is cut or removed from the base 58 in an unauthorized manner. In other embodiments, the tether 52 may include both a cut resistant cable and conductors, although only a cut-resistant cable may be utilized if desired.

Figure 8:
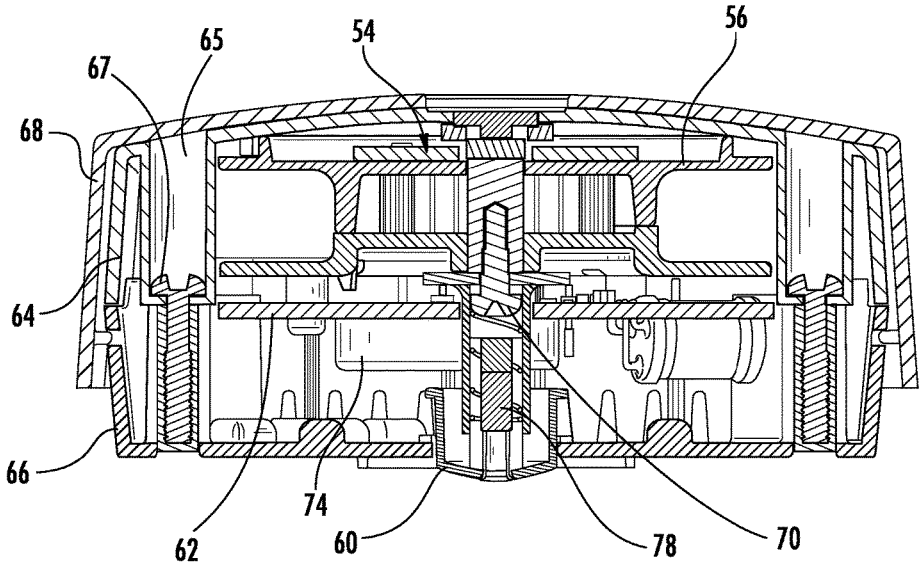
FIG. 8 is a cross-sectional view of the merchandise display security system shown in FIG. 4.
Figure 9:
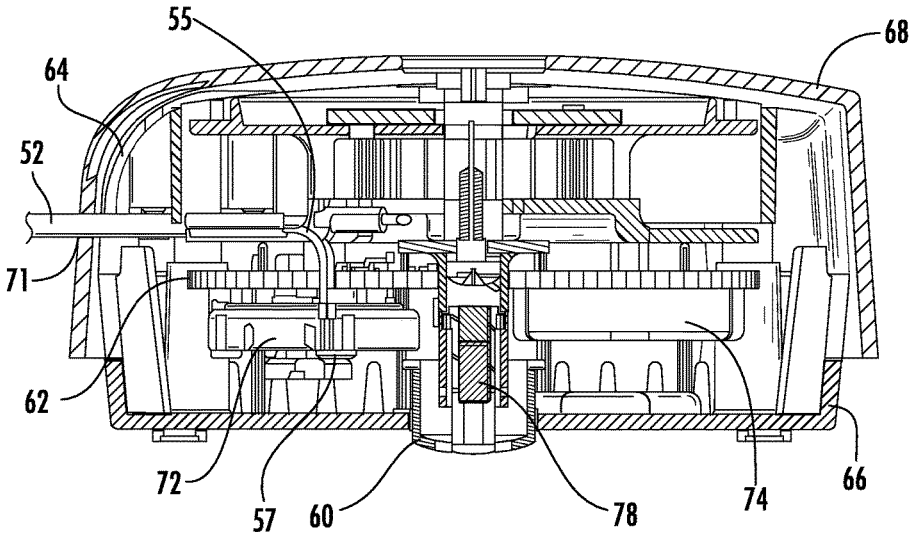
FIG. 9 is another cross-sectional view of the merchandise display security system shown in FIG. 4.
Figure 10:
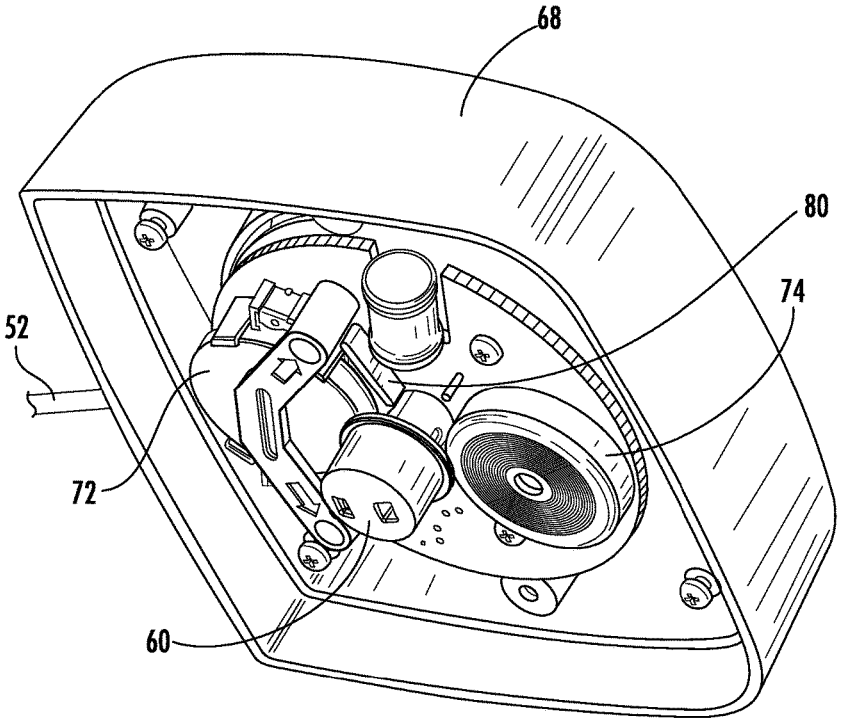
FIG. 10 is another partial bottom perspective view of the merchandise display security system shown in FIG. 4.

Moreover, the base 58 may include a sensor 60 that is configured to be activated upon unauthorized removal of the base from a support surface S, and the sensor may in electrical communication with an alarm circuit 57. For example, the sensor 60 may be a pressure or plunger switch. The pressure or plunger switch may be configured to engage a support surface S and to extend and retract relative to the base 58. The pressure or plunger switch may be biased to an extended position, such as with a spring. As shown in FIGS. 8-9, the sensor 60 may be configured to move axially along an axis. Thus, the alarm circuit 57 may be configured to detect activation of the sensor 60 and to generate an audible and/or a visible alarm signal in response to the sensor being activated.

The base 58 may also include a printed circuit board (PCB) 62. The PCB 62 may be electrically connected to one or more components of the security device 50, such as the tether 52, sensor 60, and/or alarm circuit 57. The PCB 62 may be coupled to the recoiler 54. In one embodiment, the PCB 62 is coupled to the spool 56. Thus, the PCB 62 may be configured to rotate with the spool 56 as the tether 52 is extended and retracted. The PCB 62 may be configured to rotate about the same axis that the sensor moves along axially (see, e.g., FIGS. 8-9). The sensor 60 may be coupled to the base 58 such that the sensor does not rotate with the spool 56 or PCB 62. As such, the sensor 60 may be configured to remain stationary as the spool 56 and PCB 62 rotate. Therefore, the security system 50 may not require a slip ring, expansion coil, or other components required to transfer an electrical connection between moving parts.

Figure 4:
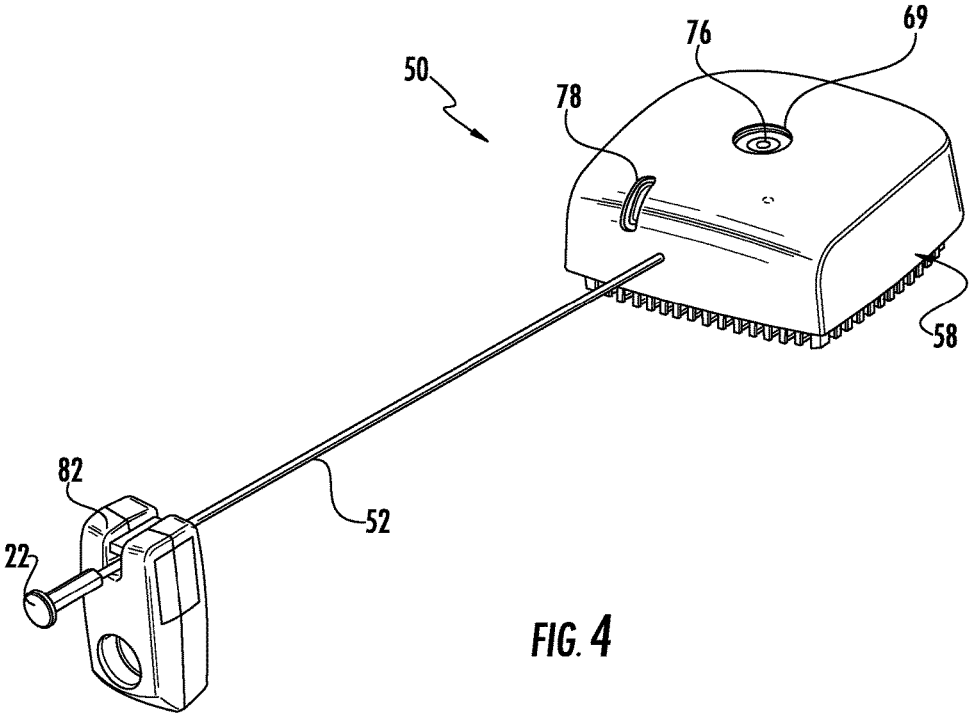
FIG. 4 is a perspective view of a merchandise display security system according to another embodiment of the present invention.
Figure 5:
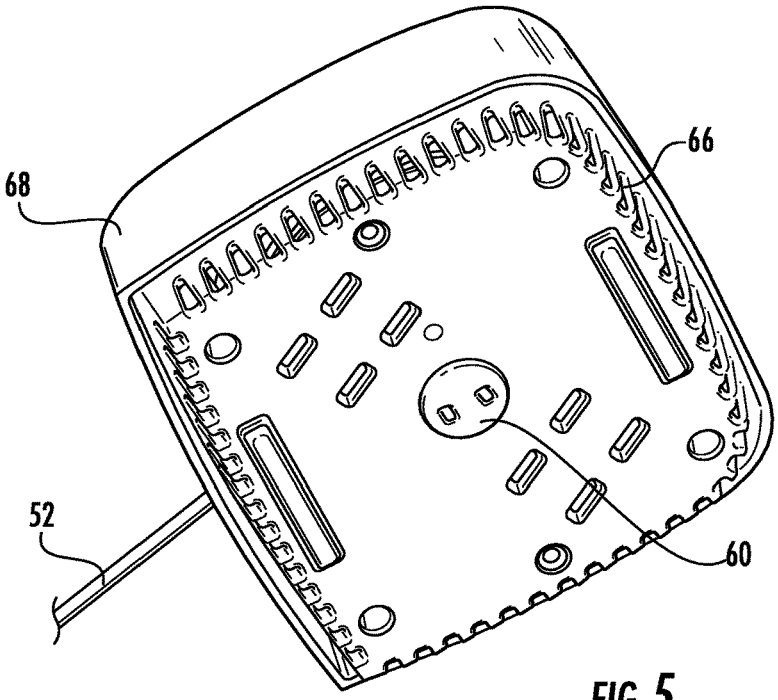
FIG. 5 is a bottom perspective view of the merchandise display security system shown in FIG. 4.

FIGS. 8-9 illustrate that the base 58 may include an upper housing 64, a lower housing 66, and a cover 68. The upper 64 and lower 66 housings are configured to cooperate with one another to house the components of the security device 50, including the recoiler 54 and PCB 62. The cover 68 may be configured to cover and extend over the upper housing 64 and at least a portion of the lower housing 66. The upper 64 and lower 66 housings may be secured together using one or more fasteners or via a snap fit. Similarly, the cover 68 may be secured to upper 64 and/or lower 66 housing via one or more fasteners or snap fit. In this example, the upper housing 64 may define one or more openings 65 for receiving fasteners 67. The fasteners 67 may be configured to engage the lower housing 66. Moreover, FIG. 4 shows that the cover 68 may include an opening 69 configured to align with a transfer port 76. In addition, the cover 68 and the upper housing 64 may include an opening 71 for receiving the tether 52 therethrough. The lower housing 66 may be configured to be secured to a support surface S as noted above.

Figure 6:
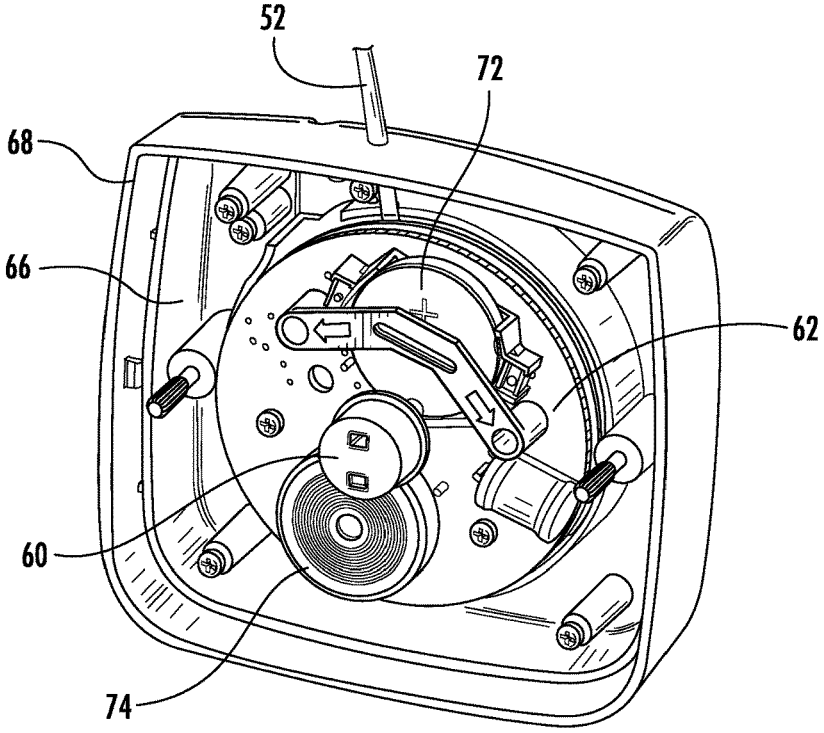
FIG. 6 is a partial bottom perspective view of the merchandise display security system shown in FIG. 4.
Figure 7:
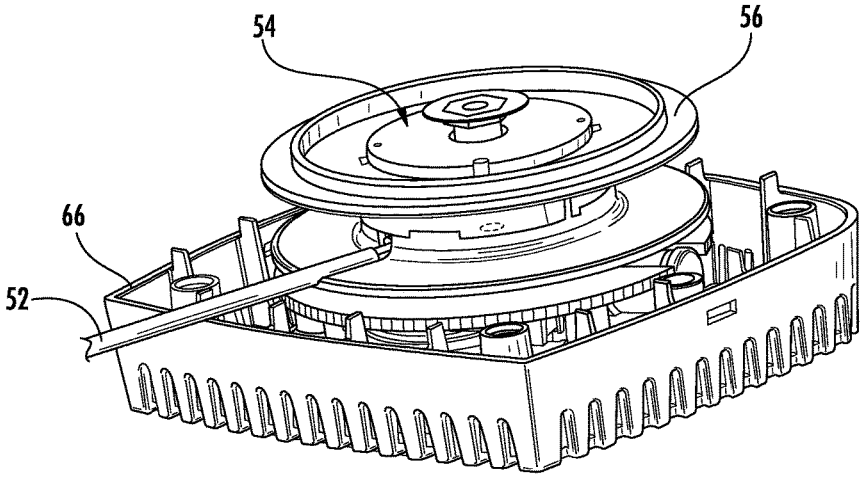
FIG. 7 is a partial side perspective view of the merchandise display security system shown in FIG. 4.

The sensor 60 may be connected to the upper housing 64, such as with a fastener 70. FIGS. 6, 8, and 9 illustrate that the base 58 may contain or otherwise include a variety of components. For example, the base 58 may house a battery 72 and an alarm device 74 (e.g., piezoelectric transducer) that are operably engaged with the PCB 62. Furthermore, FIG. 4 shows that the security device 50 may include a transfer port 76 for communicating with a key, as discussed above. Moreover, the security device 50 may include a light-emitting device 78 such as an LED for indicating a status of the security device, such that the alarm circuit 57 is armed or alarming.

In one embodiment, the security device 50 is configured to utilize a magnetic field for detecting activation of the sensor 60. For example, the sensor 50 may include a magnet 78, while the PCB 62 comprises a magnetic sensor 80 (see, e.g., FIGS. 8-10), such as a reed switch or a Hall-effect sensor. The magnetic sensor 80 may be electrically connected to the PCB 62 such that the magnetic sensor also rotates as the spool 56 rotates. In some instances, the magnetic sensor 80 may rotate circumferentially about the magnet 78 and the plunger switch. The magnet 78 and the magnetic sensor 80 may not be in physical contact with one another. The magnetic sensor 80 is configured to detect the magnet 78 when in proximity thereto (e.g., electrical switch closed). Thus, where the sensor 60 is a plunger switch, the magnetic sensor 80 may be configured to detect the magnet 78 when the plunger switch is engaged with a support surface S and thereby at least partially retracted within the base 58. Alternatively, when the plunger switch is allowed to extend from the base 58 (e.g., due to removal of the base from the support surface 5), the magnetic sensor 80 may no longer detect the presence of the magnet 78 (e.g., electrical switch open). The alarm circuit 57 may be configured to detect opening or closing of the magnetic sensor 80. The alarm circuit 57 may then generate an audible and/or a visual alarm in response to detecting opening or closing the electrical circuit or switch.

A lock mechanism 20 is configured to releasably engage an end of the tether. For example, FIG. 1 shows the lock mechanism 20 engaged with an end of the tether 18, while FIG. 2 shows the lock mechanism disengaged from the end of the tether. The end of the tether 12 may include a connector 22 that is configured to be engaged with and disengaged from the lock mechanism 20. The connector 22 may be any desired configuration for engaging the lock mechanism 20. In the illustrated example, the connector 22 is a plug configured to be inserted within the lock mechanism 20. It is noted that the size and configuration of the connector 22 is such that the connector may be inserted through an opening 24 defined in a hang tag 26 on an item of merchandise 28. For instance, FIG. 2 shows that when the connector 22 is disengaged from the lock mechanism 20, the connector is able to be inserted through the hang tag opening 24 to allow a consumer to inspect or purchase the item of merchandise 28. When unlocked from the lock mechanism 20, the connector 22 may be inserted through one or more items of merchandise 28. Thus, the security device 10 provides a similar consumer experience as locking hooks used with pegboard, slat wall, and the like. As shown in FIG. 1, the tether 18 is configured to accommodate a plurality of items of merchandise 28.

In some cases, such as shown in FIG. 4, the security device 50 may be used in conjunction with a lock mechanism, such as a hook lock 82, that is configured to couple to the tether 52. The hook lock 82 may be configured to independently lock and unlock to the tether 52. The hook lock 82 may be sized and configured to abut the connector 22. Thus, the connector 22 may alternatively function as a blocking member and prevent the hook lock 82 from sliding off of the end of the tether 52 when in a locked configuration. The hook lock 82 may also be configured to slide along the tether 52 to different positions along the length of the tether. When in an unlocked configuration, the hook lock 82 may be removed from the tether, such as for removing or adding items of merchandise 28 from the tether.

The lock mechanism 20 may be configured to lock to and unlock from the connector 22. The lock mechanism 20 may include a transfer port 30 for communicating with an internal lock mechanism for disengaging the connector 22. For example, the lock mechanism 20 may include an electrical conductor in the form of a coil having a plurality of continuous windings. The coil is arranged to correspond to a transfer port 30 of the lock mechanism 20. Thus, an electronic key 12 may be positioned within or proximate to the transfer port 30 for communicating with the lock mechanism 20. In one example, the electronic key 12 is configured to be inserted within an opening defined by the coil and transfer power to the coil inductively. The coil may be in electrical communication with a wire formed of shape memory material that is configured to shorten when power is conducted through the coil.

In one embodiment, the electronic key 12 is configured to cause the internal power source of the key to transfer electrical power to the security device 10, 50 to operate a lock mechanism 20, 82 of the security device. For example, a conductor may be coupled to a mechanical lock mechanism, and when electrical power is conducted through the conductor, a state change occurs thereby resulting in operation of the lock mechanism. In one example, the conductor is coupled to a shape memory material (e.g., Nitinol) such that electrical power transferred through the conductor results in a change in shape of the shape memory material. Such a change in shape may cause a mechanical actuation (e.g., linear or rotary) of the lock mechanism 20, 82 to thereby lock or unlock the lock mechanism. In other embodiments, the lock mechanism 20, 82 may cooperate with a motor or solenoid for operating the lock mechanism.

In one embodiment, the lock mechanism 20, 82 may provide only mechanical security to the end of the tether 12, 52. Thus, where the base 14, 58 includes an alarm circuit 57, the alarm circuit may not detect unauthorized removal of the lock mechanism 20, 82. However, it is understood that the lock mechanism 20, 82 may be electrically connected to an alarm circuit 57 in other embodiments whereby the alarm circuit is configured to generate an alarm signal (e.g., an audible and/or visible alarm) in response to unauthorized removal of the lock mechanism.

Therefore, it is apparent that any number of lock mechanisms may be employed in conjunction with various forms of power transfer for actuating a lock mechanism (e.g., inductive, capacitive, etc.). For example, where a shape memory material is utilized, a change in shape of the shape memory material may cause mechanical actuation (e.g., linear and/or rotary movement) of the lock mechanism. The shape memory material may be operably engaged with a lock mechanism in any number of configurations to facilitate such actuation. Moreover, the shape memory material may be any suitable material, such as a metal, a polymer, or a combination thereof, that is configured to change in shape (e.g., length, area, etc.) in response to a current or a change in temperature. In addition, other mechanisms may be utilized for actuating a lock mechanism, including mechanical, electrical, and/or chemical state changes. As such, the security devices 10, 50 and associated lock mechanisms 20, 82 should not be limited in light of the illustrated embodiments.

In some embodiments, a merchandise display security system comprises an electronic key 12 and a merchandise security device 10, 50 that is configured to be operated by the key. The key 12 and security device 10, 50 may be configured to wirelessly communicate with one another. In some embodiments the merchandise security device 10, 50 is not required to include a security code or to perform a handshake communication protocol in order to cooperate with the key 12. Thus, the security device 10, 50 may not include a security code. Likewise, the electronic key 12 may also not include a security code and may not be required to transmit a code to the security device 10, 50. A security code may be unnecessary where the electronic key 12 is configured to transmit power to the security device 10, 50 that is not readily duplicated by a potential thief. For example, where the electronic key 12 is configured to transmit power inductively, the inductive signature may provide increased security relative to conventional mechanical locks that utilize mechanical or magnetic actuators. For example, the electronic key 12 may be configured to transmit an inductive signature including a particular amplitude and/or frequency of a power signal that is not readily apparent to, or duplicated by, a potential thief. The inductive signature may be recognizable by the security device 10, 50 for arming and/or disarming an alarm circuit 57.

Therefore, in one embodiment, the electronic key 12 does not transmit a security code to the security device 10, 50. However, in other embodiments, the electronic key 12 may be configured to transmit a security code to the security device 10, 50. In this example, the security device 10, 50 may include a corresponding security code. Thus, the electronic key 12 may be configured to perform a handshake communication protocol with the security device 10, 50. Where the security code of the electronic key 12 matches the security code of the security device 10, 50, the electronic key may then be configured to arm and/or disarm the alarm circuit 57. In some embodiments, the electronic key 12 may also be configured to transmit electrical power to the security device 10, 50 when the security codes match.

However in other embodiments, the security device 10, 50 may not recognize a security code transmitted by the electronic key 12, such as where the security device does not include a security code. If the electronic key 12 does not receive a return signal from the security device 10, 50, the electronic key may then transmit electrical power to the security device. Thus, although the electronic key 12 may transmit a security code to the security device, the security device 10, 50 may not recognize the security code and the security code will not affect the operation of the security device. As will be readily apparent to those skilled in the art, the security code may be transmitted from the electronic key 12 to the merchandise security device 10, 50 by any suitable means, including without limitation, via one or more electrical contacts, or via optical, acoustic, electromechanical, electromagnetic or magnetic conductors, as desired. Furthermore, the security code may be transmitted by inductive transfer of data from the electronic key 12 to the merchandise security device 10, 50.

In another embodiment of a merchandise display security system, the system and method comprise an electronic key 12 with inductive transfer, and a merchandise security device 10, 50 that is operated by the key. However, the electronic key 12 is useable with any security device 10, 50 or lock mechanism 20, 82 with inductive transfer capability that requires power transferred from the key to the device or lock mechanism by induction, or alternatively, requires data transferred between the key and the device or lock mechanism and power transferred from the key to the device or lock mechanism by induction.

In one embodiment, a transfer port 16, 76 may be formed in the security device 10, 50 that is sized and shaped to receive a transfer probe of the electronic key 12. If desired, the transfer port 16, 76 may comprise mechanical or magnetic means for properly positioning and securely retaining the key 12 within the transfer port. In one embodiment, it is only necessary that the inductive transceiver of the electronic key 12 is sufficiently aligned or proximate to the corresponding inductive transceiver of the security device 10, 50 or proximate to the transfer port. Therefore, magnets are not required to position, retain and/or maintain electrical contacts provided on the electronic key 12 in electrical contact with corresponding electrical contacts provided on the security device 10, 50. In some embodiments, data and/or power is transferred from the electronic key 12 to the security device 10, 50 by wireless communication, such as infrared (IR) optical transmission. Power may be transferred from the electronic key 12 to the security device by induction across the transfer port 16, 76 of the security device 10, 50 using an inductive transceiver disposed within a transfer probe of the key that is aligned with a corresponding inductive transceiver disposed within the security device. For example, the transfer probe of the electronic key 12 may comprise an inductive transceiver coil to provide electrical power from the internal battery of the key to an inductive transceiver coil disposed within the security device 10, 50. The inductive transceiver coil of the security device 10, 50 may then transfer the electrical power from the internal battery of the key 12 to the lock mechanism 20, 82 disposed within the security device. Thus, the security device 10, 50 may include at least one conductor configured as a coil having a plurality of continuous windings. As previously mentioned, the power transferred from the key 12 may be used to unlock the lock mechanism 20, 82 without the need for various other electrically powered mechanisms, for example, an electric motor, DC stepper motor, solenoid, or the like.

In some embodiments, the security device, the lock mechanism, and the electronic key are similar to those disclosed in U.S. Provisional Appl. No. 61/904,986, entitled Tethered Security Device for Use with an Electronic Key and filed Nov. 15, 2013, U.S. Provisional Appl. No. 61/891,061, entitled Security Device for Use with an Electronic Key and filed on Oct. 15, 2013, U.S. Patent Publ. No. 2013/0081434, entitled Cabinet Lock for Use with Programmable Electronic Key and filed Sep. 28, 2012, U.S. Patent Publ. No. 2012/0047972, entitled Electronic Key for Merchandise Security Device and filed Aug. 31, 2011, U.S. Patent Publ. No. 2011/0254661, entitled Programmable Security System and Method for Protecting Merchandise and filed Jun. 27, 2011, and U.S. Pat. No. 7,737,845, entitled Programmable Key for a Security System for Protecting Merchandise and filed Dec. 14, 2006, each of which is incorporated herein by reference in its entirety. In other embodiments, the electronic key is similar to those manufactured by InVue Security Products Inc., including the IR, IR2, and IR2-S Keys.

The foregoing has described one or more embodiments of a merchandise display security device and system. Embodiments of a merchandise display security system have been shown and described herein for purposes of illustrating and enabling the best mode of the invention. Those of ordinary skill in the art, however, will readily understand and appreciate that numerous variations and modifications of the invention may be made without departing from the spirit and scope of the invention. Accordingly, all such variations and modifications are intended to be encompassed by the appended claims.

That which is claimed is:

1. A merchandise security device for securing items of merchandise from theft, the security device comprising:

a printed circuit board;

a base containing the printed circuit board and configured to be mounted to a support surface;

a sensor electrically connected to the printed circuit board and configured to engage the support surface for detecting unauthorized removal of the base from the support surface;

a tether configured to be coupled to one or more items of merchandise; and a spool rotatably disposed within the base for winding and unwinding the tether, wherein the tether is configured to be extended and retracted relative to the base, wherein the printed circuit board is coupled to the spool such that the printed circuit board is configured to rotate relative to the base when the tether is extended and retracted, and wherein the sensor is configured to remain stationary while in engagement with the support surface when the tether is extended and retracted.

2. The security device of claim 1, wherein the tether is electrically connected to the printed circuit board.

3. The security device of claim 2, wherein the tether comprises at least one conductor in electrical communication with the printed circuit board.

4. The security device of claim 1, wherein the printed circuit board comprises an alarm circuit.

5. The security device of claim 4, wherein the base comprises a transfer port configured to communicate with an electronic key for arming and disarming the alarm circuit.

6. The security device of claim 4, wherein the alarm circuit is configured to detect activation of the sensor, cutting the tether, and/or disconnecting the tether.

7. The security device of claim 1, wherein the sensor comprises a plunger switch configured to extend and retract relative to the base.

8. The security device of claim 7, wherein the base comprises an upper housing coupled to a lower housing, and wherein the plunger switch is connected to the upper housing.

9. The security device of claim 1, further comprising a magnetic sensor electrically connected to the printed circuit board.

10. The security device of claim 9, wherein the sensor comprises a magnet, and wherein the magnetic sensor is configured to detect the magnet.

11. The security device of claim 9, wherein the magnetic sensor is configured to rotate with the printed circuit board about the sensor as the tether is extended and retracted.

12. The security device of claim 11, wherein the magnet and the magnetic sensor are not in physical contact with one another.

13. The security device of claim 1, further comprising a recoiler for retracting the tether within the base and onto the spool.

14. The security device of claim 1, wherein the base does not contain a slip ring or an expansion coil.

15. A merchandise security device for securing items of merchandise from theft, the security device comprising:

a printed circuit board;

a base containing the printed circuit board and configured to be mounted to a support surface;

a sensor electrically connected to the printed circuit board and configured to engage the support surface for detecting unauthorized removal of the base from the support surface;

wherein the printed circuit board is configured to rotate relative to the base while the sensor remains stationary and while in engagement with the support surface.

16. The merchandise security device of claim 15, further comprising a tether configured to be coupled to one or more items of merchandise, wherein the tether is configured to be extended and retracted relative to the base.

17. The merchandise security device of claim 16, further comprising a spool rotatably disposed within the base for winding and unwinding the tether, wherein the printed circuit board is coupled to the spool.

18. A method for securing items of merchandise from theft, the method comprising:

securing a security device to a support surface such that a sensor engages the support surface, the sensor electrically connected to a printed circuit board and configured to detect unauthorized removal of the security device from the support surface;

coupling a tether to at least one item of merchandise, the tether secured to the security device and configured to be wound onto and unwound from a rotatable spool; and extending or retracting the tether such that the printed circuit board rotates relative to the base and the sensor remains stationary while in engagement with the support surface.

19. The method of claim 18, further comprising arming or disarming an alarm circuit electrically connected to the tether with an electronic key.

20. The security device of claim 15, wherein the sensor comprises a plunger switch configured to extend and retract relative to the base, the plunger switch configured to at least partially retract within the base when in engagement with the support surface and to extend from the base when the base is removed from the support surface.

* * * * *